US006029849A

United States Patent [19]

Meshulam

[11] Patent Number: 6,029,849

[45] Date of Patent: Feb. 29, 2000

[54] PAPERBACKED STAMP DISPENSER

[76] Inventor: Eli Meshulam, 3316 Mapu Pl., Maui, Hi. 96753-9454

[21] Appl. No.: 08/936,040

[22] Filed: Sep. 23, 1997

[51] Int. Cl.[7] ..... B65H 3/58

[52] U.S. Cl. ..... 221/26; 156/577

[58] Field of Search ..... 221/26, 25, 71, 221/73, 210, 259, 277; 156/DIG. 33, 577, 574, DIG. 28, DIG. 23

[56] References Cited

U.S. PATENT DOCUMENTS 5,178,717 1/1993 Rodriguez ..... 156/577

5,851,347 12/1998 Rodriguez ..... 156/DIG. 33

*Primary Examiner*—Kenneth W. Noland

*Attorney, Agent, or Firm*—James E. Brunton

[57] ABSTRACT

An easy-to-use apparatus for dispensing individual stamps from an elongated roll of adhesive-covered, paperbacked stamps. The apparatus has a hollow housing within which the roll of stamps is mounted and includes a novel roller mechanism that causes the stamps to be progressively dispensed from the housing with the paperbacking, which has been automatically separated therefrom, being rolled into a lower storage chamber provided in the housing. The roller of the roller mechanism is movable from a first, downward position to an upper engagement position wherein advancement of the paperbacked stamps is accomplished upon a rotational force being imparted to the roller by moving the housing of the device away from the article to which the stamp is to be affixed.

8 Claims, 5 Drawing Sheets

95a
95b
97a
79
85
87
81b
95
97
97b
A
83
81c
81a
81
65
R
100
102
69
61
73
63
70
99
-67-
-75-
95a
95
97b
B
87
85
93
89
72a
72
77
S
71
97
81
81a
83
101
102
81c
99
93
87
81b
97
83
81a
81
69
63
65
67
61

PAPERBACKED STAMP DISPENSER

BACKGROUND OF THE INVENTION

1. Field of the Invention

The present invention relates generally to devices for dispensing adhesive backed articles from a roll of paperbacked adhesive articles. More particularly, the invention concerns a stamp dispenser for dispensing individual stamps from an elongated roll of adhesive-coated, paperbacked stamps.

2. Description of the Prior Art

For many years, the United States Postal Service has sold rolls of stamps which are made up of a number of stamps each of which required wetting before it could be permanently affixed to an object such as an envelope. Recently the United States Postal Service has offered stamps in roll form, with each stamp in the roll having an adhesive coating that requires no wetting before use.

The new rolls or coils of stamps include a continuous paperbacking so that, at time of use, each stamp must be peeled from the paperbacking. Although these new coil stamps are superior to the previous coil stamps in that they do not require wetting, the inclusion of the paperbacking makes them difficult to handle. For instance, as stamps are peeled from the coil for use, the continuous paperbacking tends to wrap itself back around the coil making it difficult to access and peel the next stamp. In addition, the adhesive backed stamps tend to stick to one's fingers when peeling them from the paperbacking coil. Accordingly, those concerned with these problems recognize the need for a device to easily dispense adhesive backed stamps from the coil of paperbacking.

In an application which was earlier filed by the present inventor, a stamp dispenser was described which included a clutch mechanism and a spring-biased trigger mechanism which, when depressed, will cause simultaneous advancement of the individual stamps through a dispensing opening provided in the housing and advancement of the paperbacking toward the lower chamber of the housing. The present invention comprises an improvement of the device disclosed in the earlier filed application.

BRIEF SUMMARY OF THE INVENTION

It is an object of the present invention to provide a simplified, easy-to-use apparatus for dispensing individual stamps from an elongated roll of adhesive-covered, paperbacked stamps.

Another object of the invention is to provide an apparatus of the aforementioned character which includes a hollow housing within which the roll of stamps is mounted and in which the apparatus includes a novel roller mechanism that causes the stamps to be progressively dispensed from the housing with the paperbacking, which has been automatically separated therefrom, being rolled into a lower storage chamber provided in the housing.

Another object of the invention is to provide an apparatus as described in the preceding paragraph in which the roller of the roller mechanism is movable from a first, downward position to an upper engagement position wherein advancement of the paperbacked stamps is accomplished upon a rotational force being imparted to the roller by moving the housing of the device away from the article to which the stamp is to be affixed.

Another object of the invention is to provide a stamp dispenser of the class described which is of simple design, includes a minimum number of moving parts, is compact, lightweight and durable in use.

Another object of the invention is to provide stamp dispensing apparatus which can be inexpensively manufactured in high volume.

BRIEF DESCRIPTION OF THE DRAWINGS

While the description which follows hereinafter is meant to be representative of a number of applications of the invention, it is not exhaustive. As those skilled in the art will recognize, the basic methods and apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

DESCRIPTION OF THE INVENTION

Figure 5:
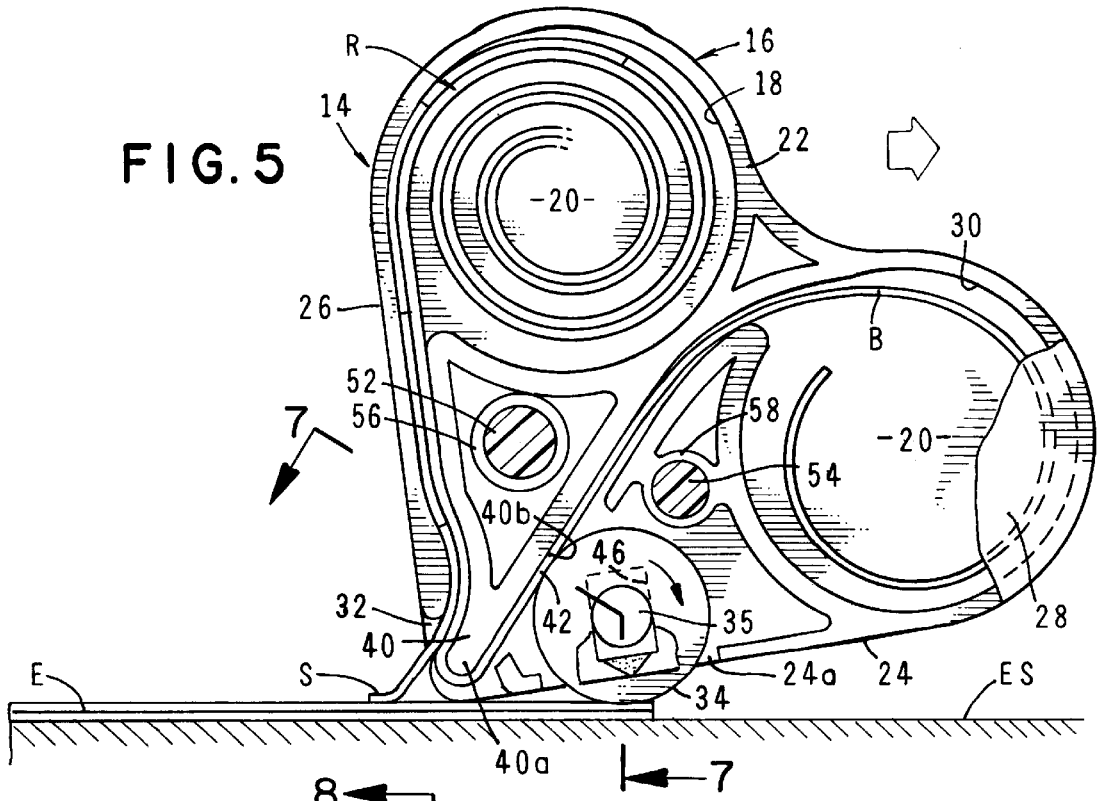
FIG. 5 is an enlarged view taken along lines 5—5 of FIG. 3.
Figure 8:
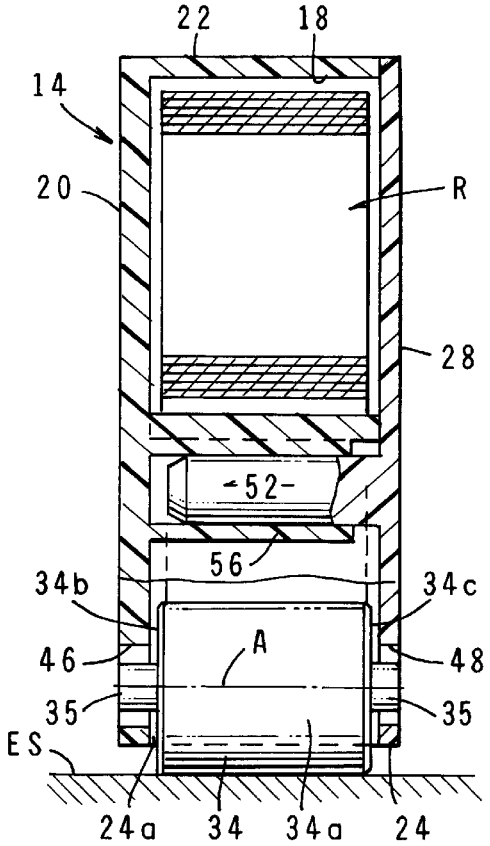
FIG. 8 is a cross-sectional view taken along lines 8—8 of FIG. 6.

Referring to the drawings and particularly to FIGS. 1 through 5, one form of the dispenser device of the invention for separating adhesive backed stamps from the paperbacking of a roll of paperbacked, adhesive backed stamps is there shown and generally designated by the numeral 14. In the form of the invention shown, the dispensing device comprises a hollow housing 16 having a roll receiving chamber 18 (FIG. 5) for receiving the roll of paperbacked, adhesive backed stamps "R" of the general character shown in FIG. 2. Housing 16 includes a side closure wall 20 (FIG. 3), a top wall 22 partially circumscribing wall 20 and a base wall 24 also partially circumscribing wall 20. Housing 16 further includes a front wall 26 which is interconnected with side wall 20 as are top and bottom walls 22 and 24 (FIG. 8). Also interconnected with side wall 20 by means of connector means, the chamber of which will presently be described, is a removable cover 28 which cooperates with front, side, top, and base walls to define the previously identified roll-receiving chamber 18 and also to define a paperbacking receiving chamber 30 (FIG. 5). Formed proximate the lower end of front wall 26 is a stamp dispensing opening 32 (FIG. 4) through which the stamps "S" of roll "R" are dispensed in a manner presently to be described.

Figure 10:
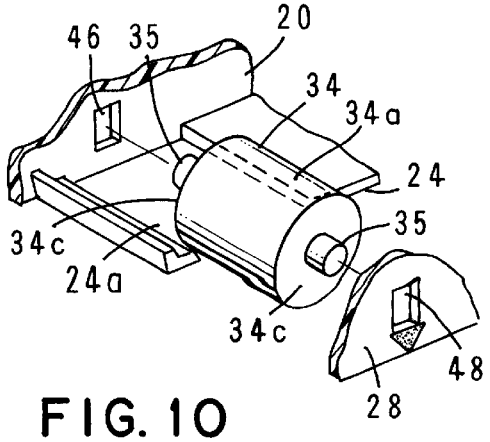
FIG. 10 is a generally perspective, fragmentary, exploded view of one form of the advancing roller and a portion of the housing of the device.
Figure 11:
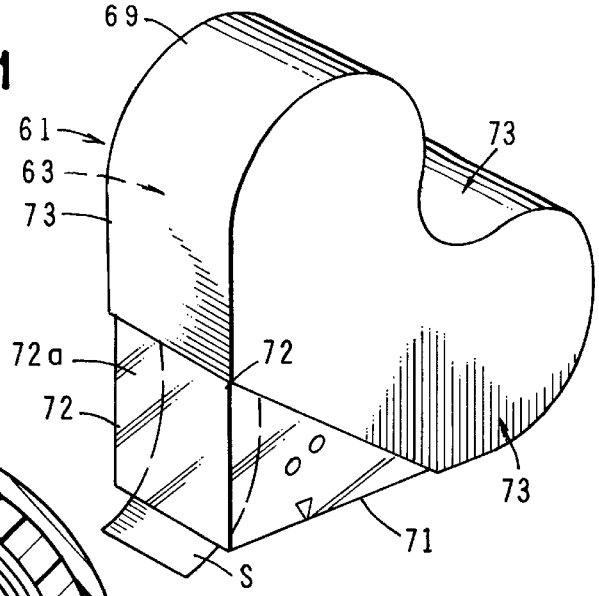
FIG. 11 is a generally perspective view of this alternate embodiment of the invention.

Forming an important aspect of the device of the present invention is advancing means for controllably urging the paperbacked, adhesive backed stamps "S" carried roll "R" outwardly of the device through opening 32. This important advancing means of the invention is partially housed within housing 16 and comprises a generally drum shaped advancing roller 34, which as best seen in FIG. 10 includes a peripheral portion 34*a* and a pair of spaced-apart ends or closure faces 34*b* and 34*c*. Extending outwardly from each of the faces 34*b* and 34*c* is a generally cylindrically shaped hub 35, the purpose of which will presently be described.

Figure 1:
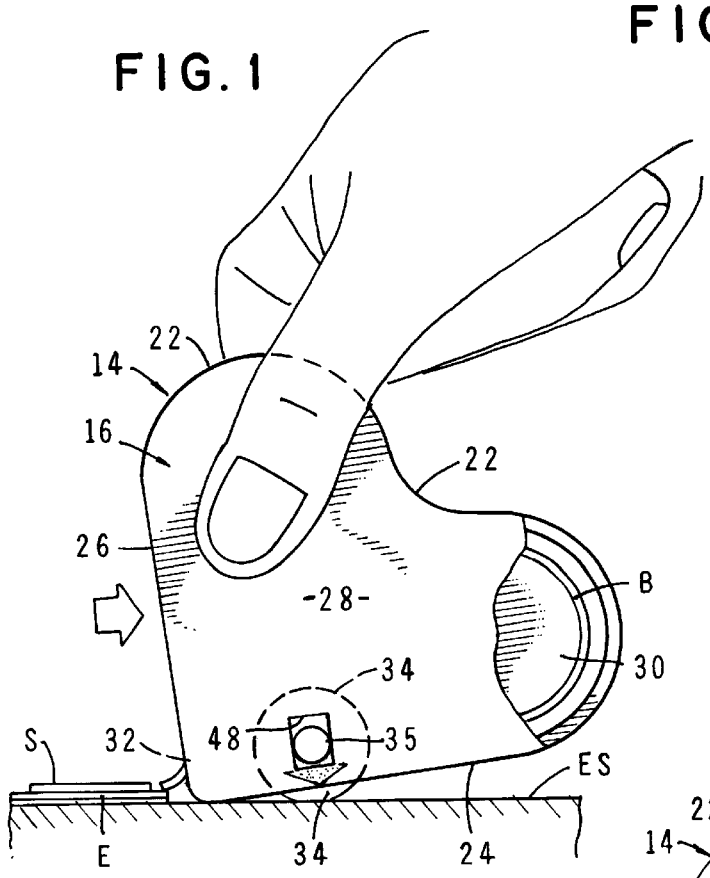
FIG. 1 is a generally diagrammatic, side-elevational view of one form of the stamp dispenser device of the present invention, partly broken away to show internal construction.
Figure 3:
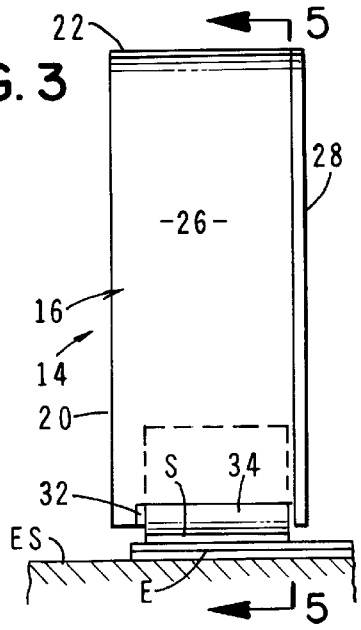
FIG. 3 is a front view of the device shown in FIG. 1.
Figure 2:
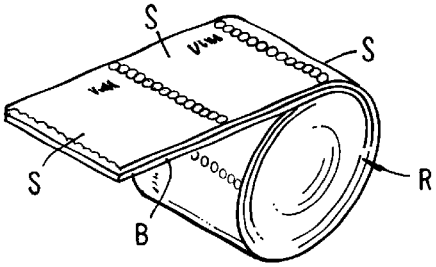
FIG. 2 is a generally perspective view of a roll of adhesive backed stamps of the character which are dispensed by the device of the invention.
Figure 4:
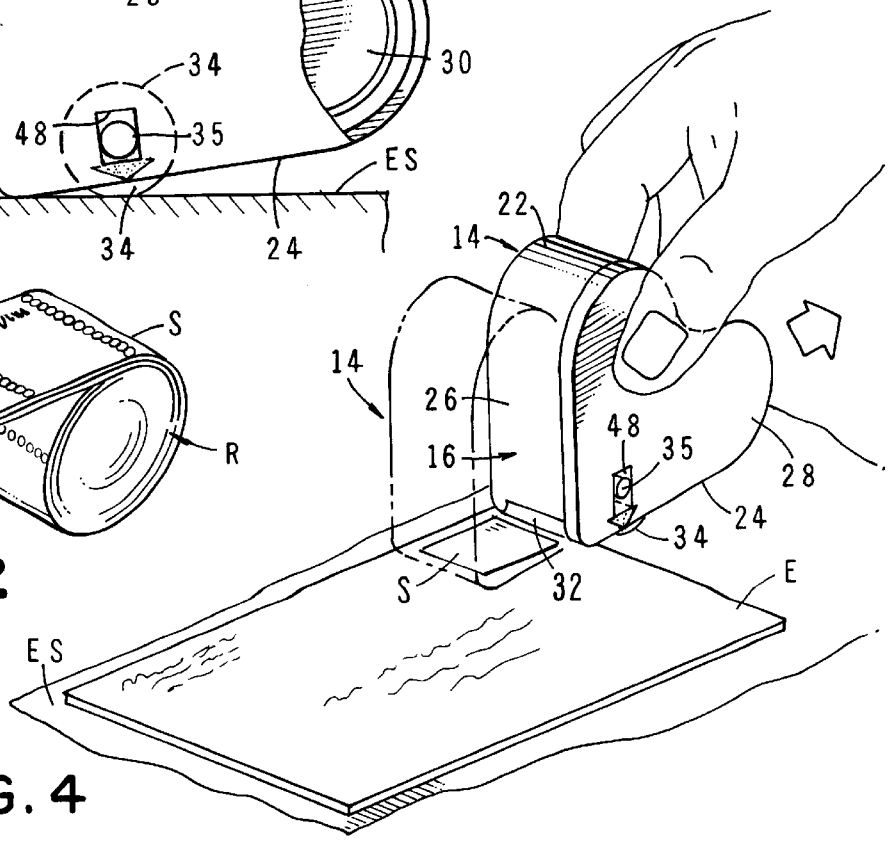
FIG. 4 is a generally perspective, diagrammatic view illustrating the dispensing of the stamp from the dispensing device of the invention.

Also forming an important aspect of the present invention is separator means for separating the adhesive backed stamps "S" from the paperbacking "B" which is affixed to and protects the adhesive-coated surface of the stamp "S" in the manner shown in FIG. 2. This important separator means here comprises a strategically configured separator protuberance 40 which is formed internally of housing 16. As best seen in FIG. 5, protuberance 40 is disposed proximate opening 32 and includes a curved engaging portion 40*a* which is adapted to engage the paperbacking "B" after the backing has been separated from the stamp portion "S" of the roll of paperbacked stamps "R". Also forming a part of the separator means of the invention is a generally planar guide surface 40*b* which comprises a continuation of protuberance 40. Surface 40*b*, along with roller 34, forms a narrow passageway 42 through which the paperbacking "B" passes during the stamp dispensing operation.

Figure 6:
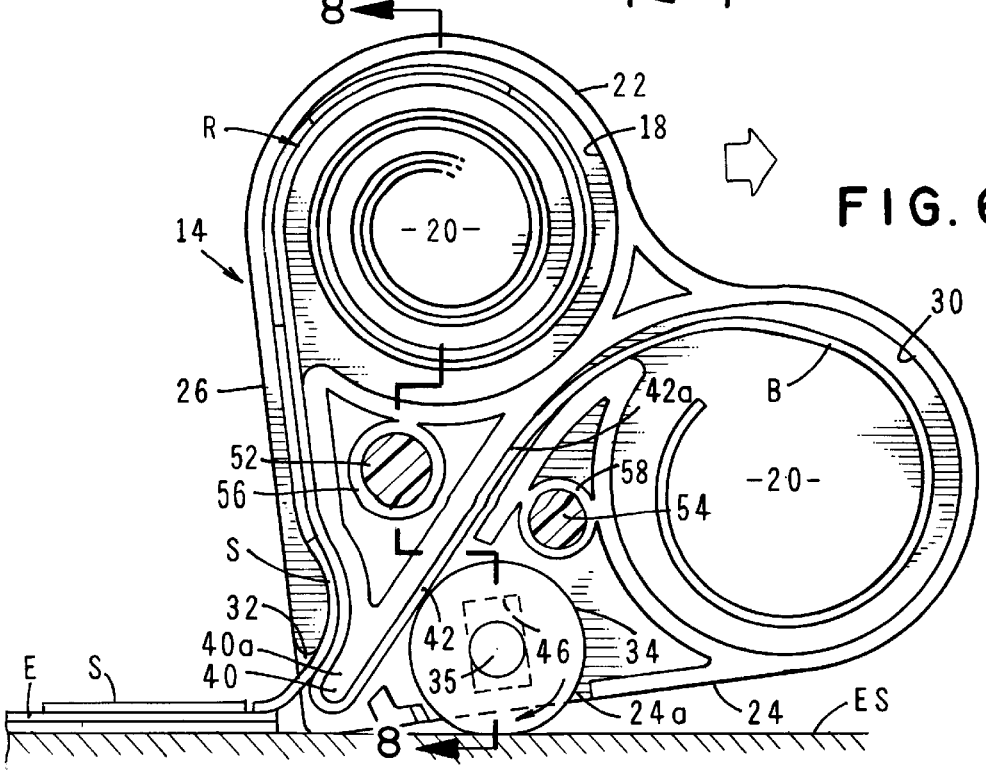
FIG. 6 is an enlarged view similar to FIG. 5, but showing the device having been moved to the right to deposit a stamp from the stamp roll onto an envelope.
Figure 7:
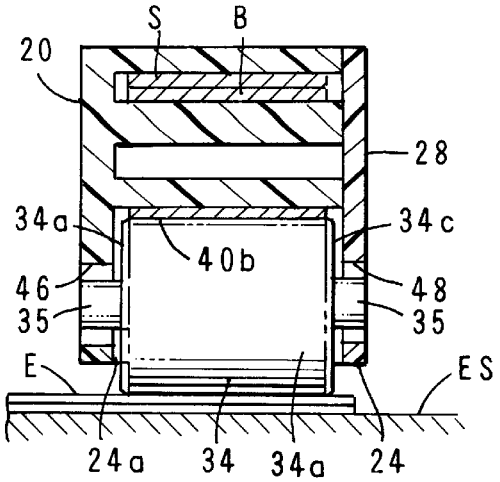
FIG. 7 is a cross-sectional view taken along lines 7—7 of FIG. 5.
Figure 9:
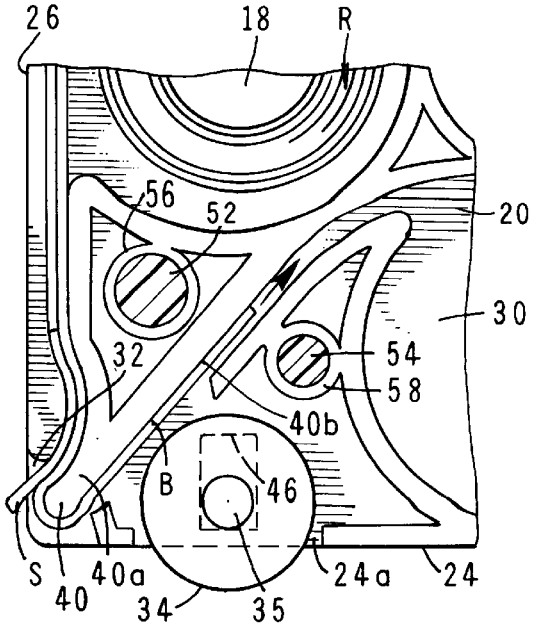
FIG. 9 is a fragmentary, side-elevational view similar to FIG. 5, but showing the advancing roller of the device in a downward, extended position wherein it is spaced from the paperbacking.

As can be seen by comparing FIGS. 5 and 9, advancing roller 34 is movable from the first extended position shown in FIG. 9 to a second retracted or driving position shown in FIGS. 5 and 6. In order to smoothly guide the travel of advancing roller 34 from the first extended position to the second retracted position novel guide means are provided. These guide means here comprise a guide slot 46 formed in side wall 20 and an indexibly aligned guide slot 48 formed in cover 28 (FIG. 10). Slots 46 and 48 are configured so as to closely receive hub-like portions 35 of advancing roller 34 so that, as the roller is moved from the extended position shown in FIG. 9 to the retracted position shown in FIGS. 5 and 6, hubs 35 will smoothly travel along the side walls of slots 46 and 48.

As indicated in FIG. 9, when the device of the invention is elevated with respect to an engaging surface "ES" (FIGS. 5 and 6), guide roller 34 will fall by force of gravity into its lower extended position wherein a portion of the roller extends outwardly of housing 16 through an opening 24*a* provided in bottom wall 24. However, when the device is gripped by the user in the manner shown in FIG. 1 and advancing roller 34 is brought into pressural engagement with either the envelope "E" of the surface "ES" (FIG. 5), the roller will move into the retracted position shown in FIGS. 5 and 6. In this retracted position, it is to be observed that a portion of the periphery 34*a* of roller 34 which is disposed within housing 16 will be moved into pressural engagement with a portion of paperbacking "B". With the advancing roller in this position, movement of the device to the right; that is, away from envelope "E" and from the position shown in the phantom lines in FIG. 4 to the position shown in the solid lines, will cause roller 34 to rotate about its axis of rotation "A", which passes through hubs 35. As the advancing roller rolls in a clockwise direction as indicated by the arrow in FIG. 5, the paperbacking "B" will be pinched between the roller and surface 40*b* of the separator means and will be controllably advanced in a direction toward chamber 30. As the paperbacking "B" is so advanced, the stamp portion of the roller "R" will be forced outwardly of opening 32 in the manner shown in FIGS. 5 and 6 with the paperbacking being separated from the adhesive backed stamp "S" by the protuberance 40 about which the paperbacking travels during movement of the paperbacking toward chamber 30.

As best seen by referring to FIG. 8, connector means are provided to removably interconnect cover 28 with side wall 20. In the form of the invention there shown, these connector means comprise first and second connector columns 52 and 54 which are connected to and extend from cover 28. Also forming a part of the connector means are first and second tubular members 56 and 58 which are connected to and extend from cover 20 (FIG. 8). With this construction, columns 52 and 54 are telescopically received within tubular members or extensions 56 or 58 in the manner shown in the drawings. When cover 28 is affixed to side 20 roller assembly 34 will be captured between wall 20 and cover 28 in the manner shown in FIG. 8 with hub portions 35 of the advancing roller extending through slots 46 and 48.

In operating the dispensing device of the present invention, cover 28 is removed from side 20 by slipping columns 52 and 54 outwardly from tubular members 56 and 58. The roll of stamps to be dispensed is then emplaced within roll-receiving chamber 18 and a portion of the stamp "S" is fed outwardly through opening 32 provided in front face 26. The paperbacking which covers the adhesive surface of stamp "S" is then passed around protuberance 40 so that the paperbacking strip will travel in the direction of the arrow shown in FIG. 9. With the stamp roll thus loaded and with a portion of the stamp "S" extending from opening 32 and a portion of the backing "B" entrained about protuberance 40*a*, cover 28 can be reconnected to side 20 by inserting columns 52 and 54 into tubular members 56 and 58 respectively. To use the device, the cover and side wall is gripped in the manner shown in FIG. 1 and a slight downward pressure is exerted against housing 16 to bring a portion of the peripheral portion of advancing roller 34 into engagement with surface "ES". As the advancing roller moves into this retracted position, it will move another portion of the peripheral portion of the roller into engagement with paperbacking "B" in the manner shown in FIGS. 5 and 6. A movement of the device from the position shown in the phantom lines of FIG. 4 to the position shown in the solid lines will cause advancing roller 34 to rotate in a clockwise direction. This clockwise rotation of advancing roller 34 will urge the paperbacking "B" to move in the direction of the arrow of FIG. 9 toward backing receiving chamber 30. At the same time as the backing moves into chamber 30, the stamp portion "S" of the roll will move outwardly through opening 32 from the position shown in FIG. 5 and to the position shown in FIG. 6 wherein the stamp is in adhesive engagement with an article such as an envelope or post card "E" of the character shown in FIG. 4. With +the stamp thus affixed to the envelope "E", the stamp can be separated from the roll in the manner previously described. After affixing the stamp, the device can then be lifted into the position shown in FIG. 9 wherein roller 34 will once again drop by force of gravity into the extended position shown in FIG. 9. To affix another stamp to an envelope or post card, the steps described in the preceding paragraph are repeated.

Figure 12:
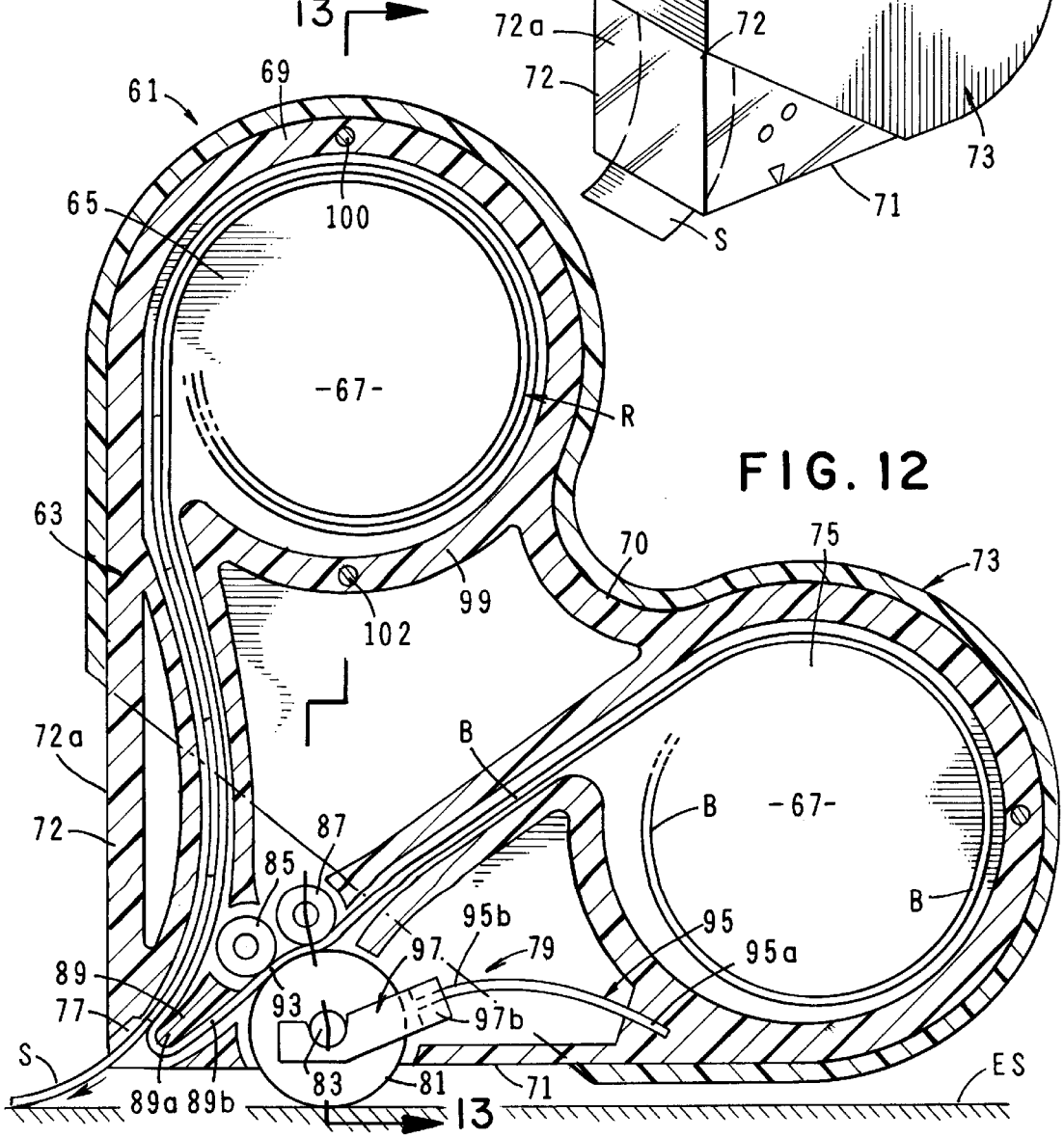
FIG. 12 is a greatly enlarged, side-elevational, cross-sectional view of the apparatus shown in FIG. 11.

Turning to FIGS. 11 through 15, an alternate form of the dispenser device of the invention is there shown and generally designated by the numeral 61. This alternate form of the invention is similar in many respects to the earlier described embodiment and comprises a hollow housing 63 having a roll receiving chamber 65 (FIG. 12) for receiving the roll of paperbacked, adhesive backed stamps "R" of the general character shown in FIG. 2. Housing 63 includes a side closure wall 67 (FIG. 13), a top wall 69 partially circumscribing wall 70 and a base wall 71 also partially circumscribing wall 67 (FIG. 12). Housing 63 further includes a front wall 72 which is interconnected with side wall 67 as are top and bottom walls 69 and 71. A portion 72*a* of front wall 72 is substantially transparent so that passage of the stamps toward the dispensing opening of the device can be viewed. Also forming a part of housing 63 is a strategically shaped, removable cover 73 which cooperates with front, side, top, and base walls to define the previously identified roll-receiving chamber 65 and also to define a paperbacking receiving chamber 75 (FIG. 12). Formed proximate the lower end of front wall 72 is a stamp dispensing opening 77 (FIG. 14) through which the stamps "S" of roll "R" are dispensed in a manner presently to be described.

Figures 13, 14, 15:
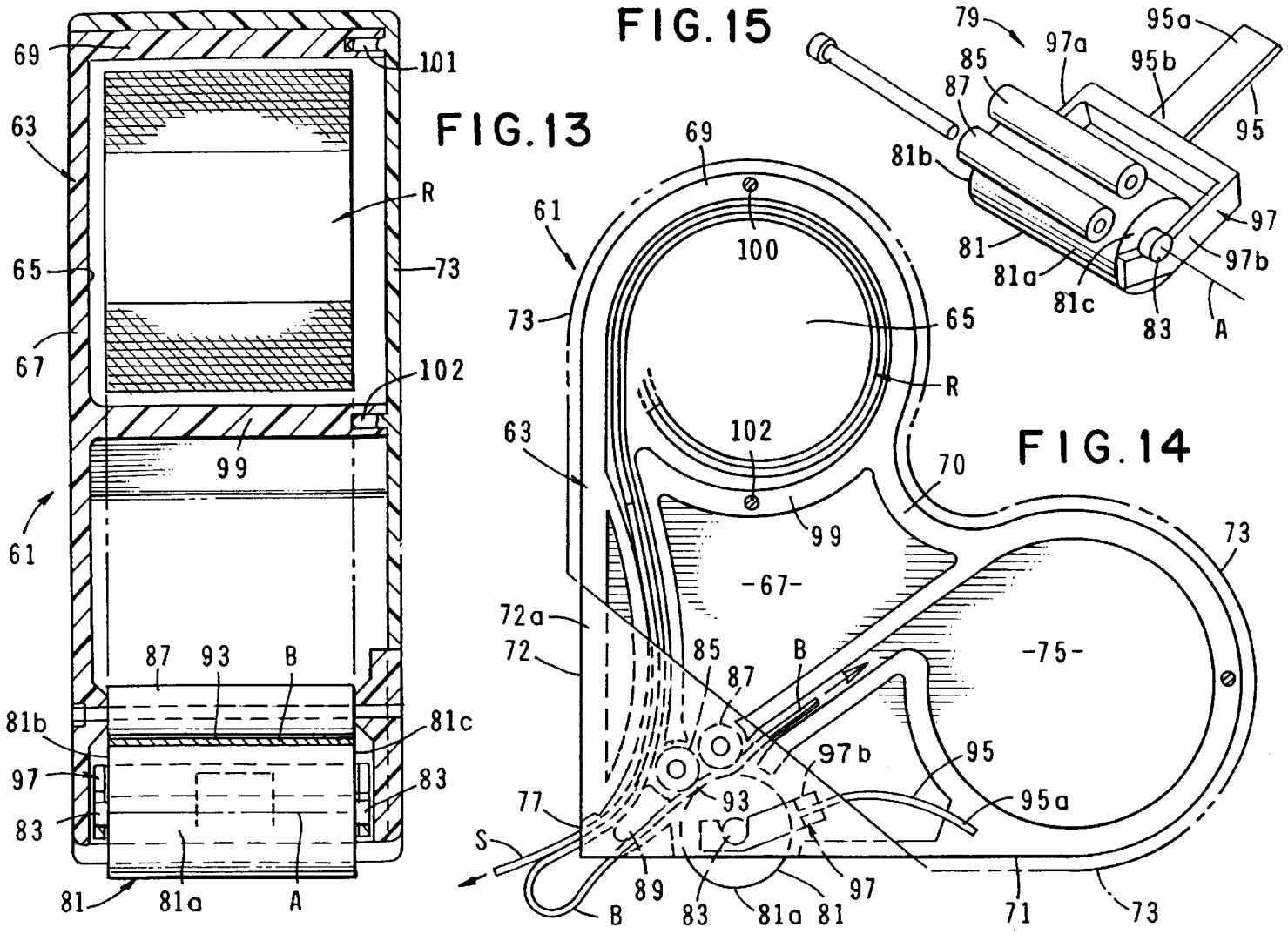
FIG. 13 is a cross-sectional view taken along lines 13—13 of FIG. 12.
FIG. 14 is a view similar to FIG. 12 illustrating the manner of threading the backing material through the apparatus of the invention.
FIG. 15 is a generally perspective, exploded view of the idler roller mechanism of the embodiment of the invention shown in FIG. 12.

As was the case with the earlier described embodiment of the invention, this alternate embodiment also includes advancing means for controllably urging the paperbacked, adhesive backed stamps "S" carried roll "R" outwardly of the device through opening. The advancing means of this latest form of the invention is of a different construction and comprises a novel multiple roller assembly 79 which is housed within housing 63 in the manner best seen in FIG. 12. Assembly 79 comprises a generally drum shaped advancing roller 81, which as best seen in FIGS. 12, 13 and 15, includes a peripheral portion 81*a* and a pair of spaced-apart ends or closure faces 81*b* and 81*c*. Extending outwardly from each of the faces 81*b* and 81*c* is a generally cylindrically shaped hub 83, the purpose of which will presently be described. Also forming a part of roller assembly 79 is a pair of idler rollers which are rotatably mounted within housing 63 proximate advancing roller 81. These idler rollers which are designated in the drawings by the numbers 85 and 87 form a part of the feed means of the invention and cooperate with advancing roller 81 to smoothly advance the stamps and paper-backing in the manner indicated by the arrows in FIG. 12.

Also forming an important aspect of the present invention is separator means for separating the adhesive backed stamps "S" from the paperbacking "B" which is affixed to and protects the adhesive-coated surface of the stamp "S" in the manner shown in FIG. 2. This important separator means here comprises a strategically configured separator protuberance 89 which is formed internally of housing 63. As best seen in FIG. 12, protuberance 89 is disposed proximate opening 72 and includes a curved engaging portion 89*a* which is adapted to engage the paperbacking "B" after the backing has been separated from the stamp portion "S" of the roll of paperbacked stamps "R". Also forming a part of the separator means of the invention is a generally planar guide surface 89*b* which comprises a continuation of protuberance 87. As best seen in FIG. 12, idler rollers 85 and 87 in cooperation with advancing roller 81, form a narrow passageway 93 through which the paperbacking "B" passes during the stamp dispensing operation.

As can be seen in FIGS. 12 and 14, advancing roller 81 is continuously biased by biasing means in a direction toward idler rollers 85 and 87. With this construction, when the backing paper is fed into passageway 93 in the manner illustrated in FIG. 14, guide roller 81 cooperates with idler rollers 85 and 87 to smoothly guide the travel of the backing paper toward chamber 75. This biasing means here comprises a length of flat spring material 95, one end 95*a* of which is affixed to base wall 71 and the other end 95*b* of which is connected to a yoke-like member 97 having spaced apart arms 97*a* and 97*b* which support hubs 83 of advancing roller 81, (FIG. 15). Yoke-like member 97, which is affixed to base wall 71 via spring 95 forms a part of the advancing roller support means of the invention and functions to rotatably support advancing roller 81 in the manner shown in FIG. 15.

As indicated in FIG. 12 when the device of the invention is in its operable position with advancing roller 81, engaging surface "ES" and with the device being gripped by the user in the manner previously described, a portion of the periphery 81*a* of roller 81 which is disposed within housing 63 will pressurally engage a portion of paperbacking "B" so as to force the paper backing into engagement with idler rollers 85 and 87. With the advancing roller in this position, movement of the device to the right as shown in FIG. 12, will cause roller 81 to rotate about its axis of rotation "A", which passes through hubs 83 (FIG. 15). As the advancing roller rolls in a clockwise direction as indicated by the arrow in FIG. 12 the paperbacking "B" will be pinched between the roller and the idler rollers and will be controllably advanced in a direction toward chamber 75. As the paperbacking "B" is so advanced, the stamp portion of the roll "R" will be forced outwardly of opening 77 in the manner shown in FIGS. 12 and 15 with the paperbacking being separated from the adhesive backed stamp "S" by the protuberance 89 about which the paperbacking travels during movement of the paperbacking toward chamber 75.

As best seen by referring to FIG. 13, connector means are provided to removably interconnect cover 73 with a connector wall 99 which is connected to and extends from wall 67, and with top wall 69. These connector means here comprise first and second connector pins 102 which are connected to and extend from cover 73 (FIG. 13). As shown in FIG. 13, the connector pins are telescopically received within small bores provided in walls 69 and 99. When cover 73 is thus affixed to walls 69 and 99 chambers 65 and 75 are closed. However, when the cover is removed, the chambers will be opened to permit a new roll of stamps to be emplaced within chamber 65 and to permit removal of the paperbacking which has been accumulated within chamber 75.

In operating the dispensing device of this latest form of the invention, with cover 73 removed, the roll of stamps to be dispensed is first placed within roll-receiving chamber 65 and a portion of the stamp "S" is fed outwardly through opening 77 provided in front face 72. The paperbacking which covers the adhesive surface of stamp "S" is then passed around protuberance 89 and fed between advancing roller 81 and idler rollers 85 and 87 so that the paperbacking strip will travel in the direction of the arrow shown in FIG.

12. With the stamp roll thus loaded and with a portion of the stamp "S" extending from opening 77 and a portion of the backing "B" entrained about protuberance 80*a*, cover 73 can be reconnected to walls 69 and 99. To use the device, the sides of the housing are gripped between the user's fingers and a slight downward pressure is exerted to bring a portion of the peripheral portion of advancing roller 81 into engagement with surface "ES". As the advancing roller moves into this retracted position, it will move another portion of the peripheral portion of the roller into engagement with paperbacking "B" in the manner shown in FIG. 12. Movement of the device to the right will then cause advancing roller 81 to rotate in a clockwise direction. This clockwise rotation of advancing roller 81 will urge the paperbacking "B", which has been moved into engagement with idler rollers 85 and 87, to smoothly move in the direction of the arrow of FIG. 12 toward backing receiving chamber 75. At the same time as the backing moves into chamber 75, the stamp portion "S" of the roll will move outwardly through opening 77 from the position shown in FIG. 14 and to the position shown in FIG. 12 wherein the stamp can be placed into adhesive engagement with an article such as an envelope or post card.

After the stamp has been affixed, it can be separated from the roll in the manner previously described. Exhaustion of the roll can be observed by viewing the stamps passing downwardly past transparent portion 72*a*.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A dispenser device for separating adhesive backed stamps from the paperbacking of a roll of paperbacked, adhesive backed stamps and for dispensing the adhesive backed stamps one at a time from said device, said device comprising:

(a) a housing having a roll receiving chamber for rotatably supporting the roll of paperbacked, adhesive backed stamps, said housing including a side wall, a top wall, a base wall and a front wall all connected to said side wall, said front wall having a stamp dispensing opening and said base wall having an opening;

(b) advancing means carried by said housing for advancing said paperbacked, adhesive backed stamps in a direction toward said stamp dispensing opening, said advancing means comprising an advancing roller rotatably connected to said housing proximate said roll receiving chamber for engaging the paperbacking of the roll of paperbacked, adhesive backed stamps to urge the adhesive backed stamps to move in a direction toward said stamp dispensing opening, said advancing roller having a peripheral portion extending through said opening in said base wall, said advancing roller being movable within said housing relative to said opening in said base wall between a first extended position and a second retracted position;

(c) separator means comprising a separator protuberance formed on said housing proximate said stamp dispensing opening for separating the adhesive backed stamps from the paperbacking as the paperbacked, adhesive backed stamps are advanced toward said article dispensing opening by said advancing means.

2. A dispenser as defined in claim 1 in which said separator means further includes a guide surface disposed proximate said advancing roller, said guide surface and said advancing roller cooperating to form feed means for engagement with the paperbacking when said advancing roller is in said second retracted position to urge the paperbacked stamps to move toward said stamp dispenser opening upon rotation of said advancing roller.

3. A dispenser as defined in claim 2 in which said advancing roller has an axis of rotation and includes first and second hubs coaxially disposed with said axis of rotation and in which said housing further includes guide means for guiding movement of said advancing roller between said first and second positions and for permitting rotation of said advancing roller about said axis of rotation.

4. A dispenser as defined in claim 3 in which said guide means comprises a guide slot formed in said side wall and an opposing guide slot formed in said cover.

5. A dispenser as defined in claim 4 in which said peripheral portion of said advancing roller is movable into pressural engagement with a surface in a manner to cause said advancing roller to move from said first extended position to said second retracted position wherein said advancing roller is in pressural engagement with the paperbacking.

6. A dispenser as defined in claim 5 further including a paperbacking receiving chamber disposed proximate said roll receiving chamber.

7. A dispenser device for separating adhesive backed stamps from the paperbacking of a roll of paperbacked, adhesive backed stamps and for dispensing the adhesive backed stamps one at a time from said device, said device comprising:

(a) a housing having a roll receiving chamber for rotatably supporting the roll of paperbacked, adhesive backed stamps and a paperbacking receiving chamber for storing the paperbacking, said housing including a side wall, a cover removably connected to said side wall, a base wall and a front wall all connected to said side wall, said front wall having a stamp dispensing opening formed therein;

(b) advancing means carried by said housing for advancing the paperbacked, adhesive backed stamps in a direction toward said stamp dispensing opening, said advancing means comprising an advancing roller rotatably mounted within said housing proximate said roll receiving chamber;

(c) separator means disposed within said housing for separating the adhesive backed stamps from the paperbacking;

(d) feed means disposed within said housing proximate said advancing roller for cooperating with said advancing roller to cause the paperbacking to move toward said paperbacking receiving chamber when said advancing roller is rotated, said feed means comprising at least one idler roller rotatably mounted within said housing proximate said advancing roller; and (e) advancing roller support means for supporting said advancing roller within said housing, said advancing roller support means comprising a yoke-like member connected to said base wall.

8. A dispenser as defined in claim 7 in which said advancing roller support means further includes biasing means connected to said base wall for urging said advancing roll toward said pair of idler rollers.

* * * * *